United States Patent [19]

Krasij

[11] Patent Number: 4,812,793

[45] Date of Patent: Mar. 14, 1989

[54] CIRCUIT BREAKER HOUSING WITH CENTERED ACTUATOR

[75] Inventor: Bohdan Krasij, Avon, Conn.

[73] Assignee: Carlingswitch, Inc., West Hartford, Conn.

[21] Appl. No.: 151,927

[22] Filed: Feb. 3, 1988

[51] Int. Cl.[4] ..... H01H 75/00; H01H 77/00; H01H 83/00

[52] U.S. Cl. ..... 335/8; 200/303; 335/202

[58] Field of Search ..... 335/8, 9, 10, 202; 200/303, 293

[56] References Cited

U.S. PATENT DOCUMENTS

| | | | |
|---|---|---|---|
| 4,077,024 | 2/1978 | Lisnay | 335/8 |
| 4,206,430 | 6/1980 | Rusch et al. | 335/10 |
| 4,347,488 | 8/1982 | Mune et al. | 335/9 |

*Primary Examiner*—H. Broome
*Attorney, Agent, or Firm*—McCormick, Paulding & Huber

[57] ABSTRACT

A two pole circuit breaker has a central opening to receive the single actuator provided for setting and resetting the two breaker mechanisms. These mechanisms are compactly housed in two chambers that are defined by half sections which are in turn provided inside an outer shell that defines the top opening. In one version the actuator is a pushbutton that is coupled to both breaker mechanisms. In other versions the actuator is in the form of a toggle or a rocker with coupling means to both breaker mechanisms. In a preferred embodiment the half sections that define the breaker mechanism chambers include a center section of I-shape that defines the adjacent chambers and also accommodates a lamp to light the rocker/actuator and/or a well to receive a light switch that can be wired to provide remote indication of switch condition. Provision is made to mount inertia wheels in both breaker mechanisms with the mass of each wheel being minimized as a result of locating the wheel's axis between the armature pivot point and the pin and slot coupling between the armature and the inertia wheel itself.

18 Claims, 9 Drawing Sheets

CIRCUIT BREAKER HOUSING WITH CENTERED ACTUATOR

This invention relates generally to circuit breaker housings of the size and type that require a symmetrically arranged centered operator or actuator. Such circuit breakers are provided in panel openings that are generally closely spaced to one another and each breaker must also be located relatively close to the panel itself, that is have a shallow depth so as not to extend too far behind the panel.

Molded case magnetic circuit breakers generally have operating levers that are provided off center relative to the housing and have housings that are not well adapted to being mounted in panels having minimal space behind the panel. The advantages of the present invention are most apparent in a two pole circuit breaker having a single centered actuator.

SUMMARY OF THE INVENTION

In accordance with the present invention a two pole molded plastic circuit breaker case or housing is defined by two side-by-side split case subassemblies which are provided alongside one another and house the two circuit breaker mechanisms. A common trip linkage is provided to interconnect these mechanisms. A single top opening is defined by the mating half sections and an outer shell surrounds these assembled half sections and has side walls overlying the half sections on both ends as well as the exposed side portions thereof. The half sections themselves define the lower wall of the housing but as will be apparent the resulting circuit breaker housing is defined both by the half sections of the subassemblies and by the outer shell. The outer shell defines a centrally located boss having an opening to receive the actuator for setting and resetting the circuit breaker mechanism provided inside the individual half sections.

In one version each pole has two half sections. In a second and preferred embodiment a one-piece molded "half" section defines the adjacent side-by-side cavities in a two pole circuit breaker. The term "half" section as used herein is intended to include such a one piece construction for a back-to-back split case assembly.

DETAILED DESCRIPTION OF FIGS. 1–3, 7 AND 8

Figure 3:
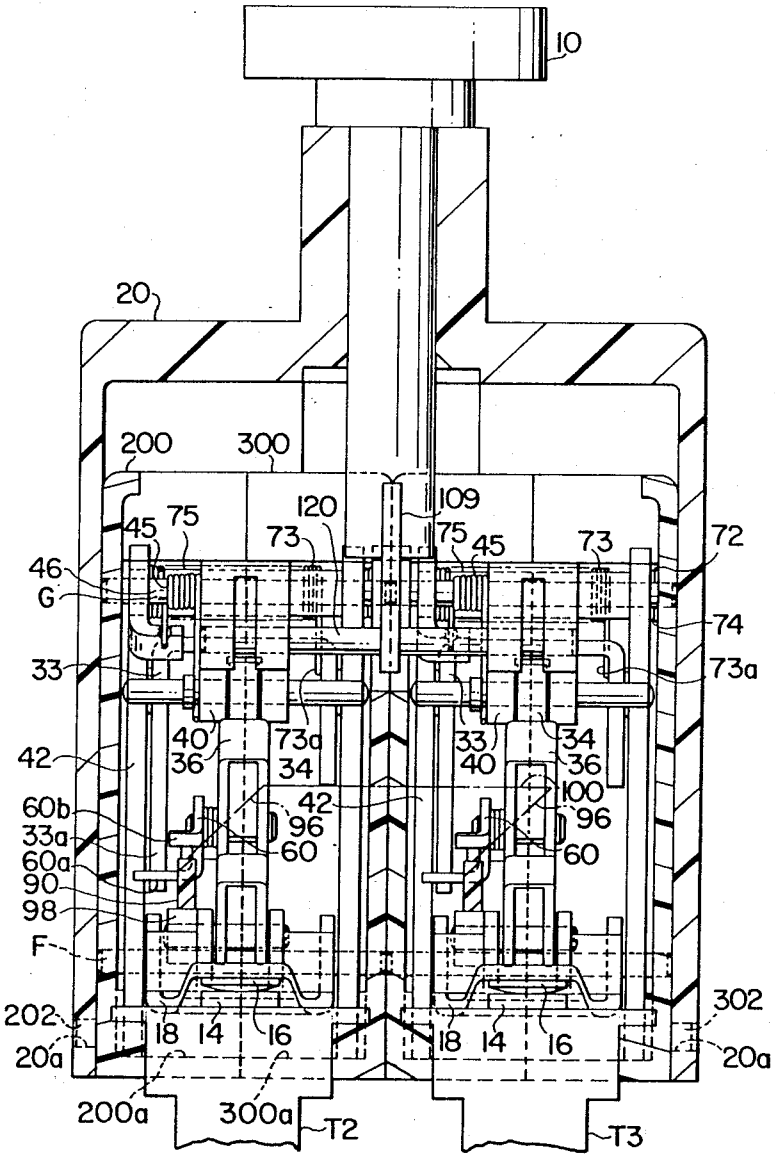
FIG. 3 is a sectional view taken generally on the line 3—3 of FIG. 1.
Figure 1:
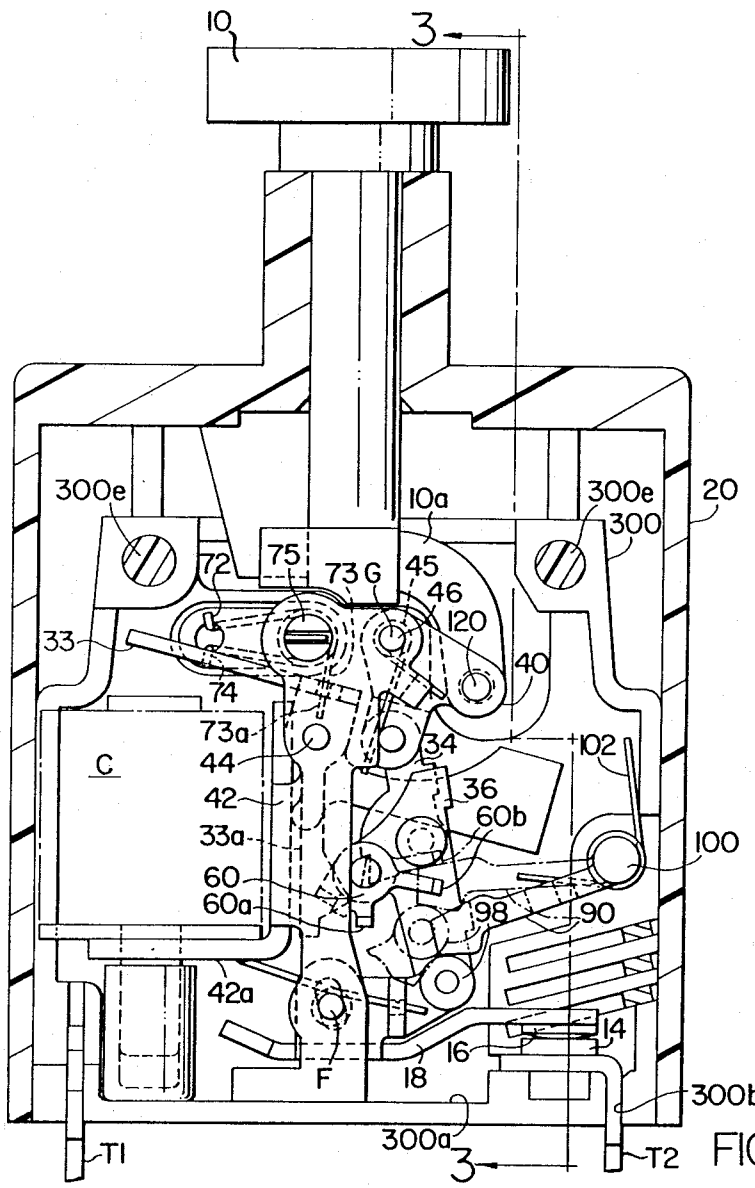
FIG. 1 shows in vertical section a pushbutton type circuit breaker having a housing constructed in accordance with one version of the present invention.
Figure 2:
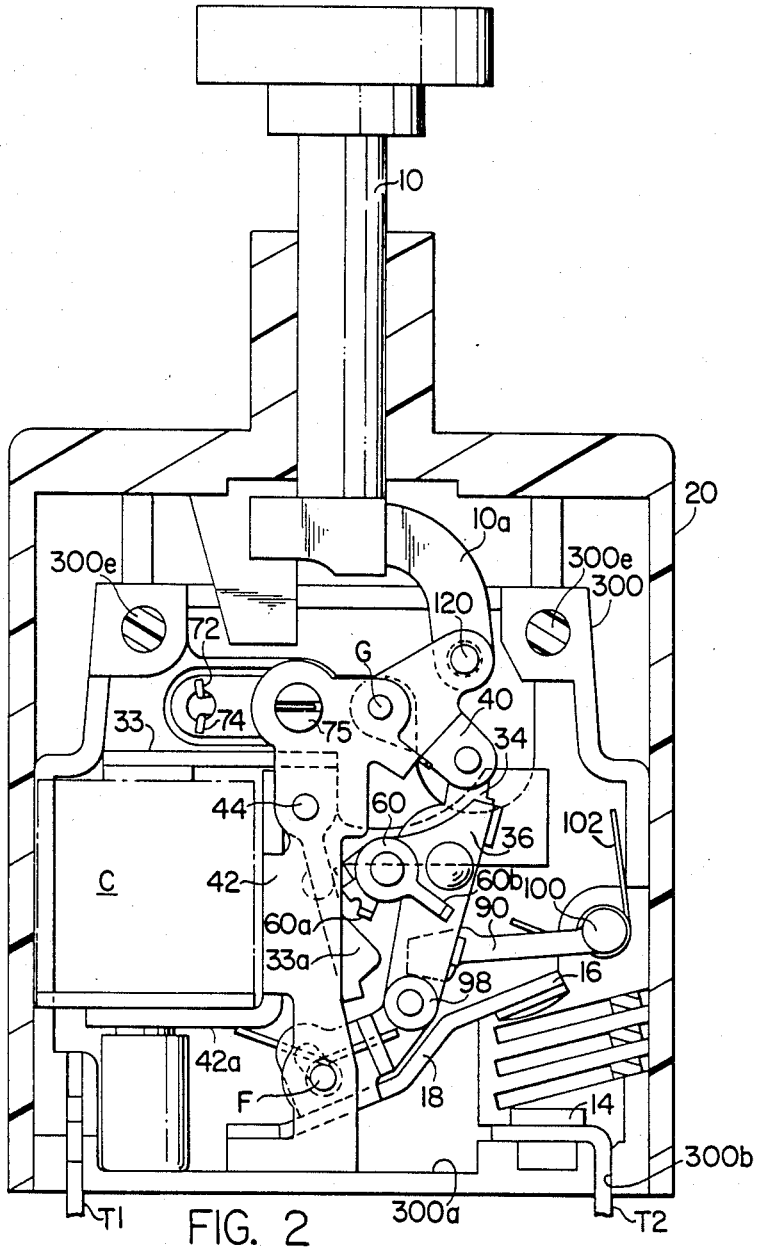
FIG. 2 is a view similar to that of FIG. 1 but illustrating the pushbutton in its tripped condition with the circuit breaker contacts open.

Turning now to the drawings in greater detail, and referring particularly to FIGS. 1–3 inclusively, these views illustrate a two pole circuit breaker constructed in accordance with the present invention and characterized by an operating member or actuator protruding through a top opening in the outer shell of the breaker. In the form of the invention shown in FIGS. 1–3 the actuator is a pushbutton 10.

FIG. 3 shows two circuit breaker mechanisms provided in parallel relationship alongside one another to achieve individual circuit tripping for two circuits. Four terminals are provided at the base of the circuit breaker housing in this configuration for the breaker. These terminals are indicated generally at T1, T2 and T3. The fourth terminal not being visible in these views.

The pushbutton 10 is shown in its normal depressed condition in FIGS. 1 and 3, and in its extended position in FIG. 2. FIG. 1 illustrates the contacts of the circuit breaker mechanism in a closed condition. Fixed contact 14 is provided on the upper end of terminal T2 and the movable contact 16 is provided on a lever 18 movable between the position shown for it in FIG. 1 to that of FIG. 2 in response to an overcurrent condition in a circuit that includes terminals T1 and T2.

Each of the circuit breaker mechanisms provided inside the case may be similar to that disclosed in prior art U.S. Pat. No. 4,347,488, and the mechanism itself is generally similar to that of prior art U.S. Pat. No. 2,360,922. While the mechanism itself is generally known, a brief description may be in order here. Terminal T1 is electrically connected by means of a flexible lead (not shown) to one end of a solenoid coil C, and the other end of the coil is electrically connected to the movable contact lever 18 by another flexible lead (not shown). In response to a predetermined current overload in the coil C an electromagnetic field is generated causing armature 33 to move from the FIG. 1 to the FIG. 2 position by the solenoid action created by the coil. An internal plunger (not shown) is provided for this purpose within the coil. The movable contact lever 18 is biased toward the position shown in FIG. 2 (that is toward the open condition) and is adapted to be mechanically closed by means of the pushbutton 10. This closing motion of the contacts is achieved through a three bar linkage consisting of the movable contact lever itself, a collapsible link in the form of elements 34 and 36, and a crank arm 40. The movable contact lever 18 and the crank arm 40 are pivotably supported in a fixed frame member 42 which frame member serves to support the coil C on a lower leg 42a, and to pivotably support the armature 33 for rotation on pin 44.

Two springs are wound around a spindle shaft 75 provided for them in the frame as shown at 72, 73 and 74 in FIG. 1. The return spring 73 for the armature is wound around the shaft or pin 75 and one end passes through an opening provided for it in the shaft 75. The return spring 73 encircles the shaft 75 and has a depending tang which is received in a slot provided for this purpose in the armature 33. A friction spring has two legs 72 and 74 provided in the same frame hole opening and has its coils wrapped around shaft 75 as shown in FIG. 3. This configuration permits the return force on the armature to be varied by rotating of the spindle shaft 75.

A return spring 45 is provided for the crank arm 40 and this spring is preferably in the form of a torsion spring wound around the shaft 46 provided for it in the frame 42. FIG. 3 shows these springs from another direction. This view also shows the ends of the shaft 75 in openings defined for it in the half sections 200 and 300.

Armature 33 is configured to provide a depending lever arm 33*a* adapted to move from the FIG. 1 to the FIG. 2 position in response to the overcurrent condition mentioned previously, and this motion of the arm 33*a* causes the collapsible toggle link 34/36 to collapse through the action of a device 60 which is provided on the link 36 and has a projection that is engaged by the depending crank arm 33*a* of the armature 33. As best shown in FIG. 3 the arm 33*a* actually engages a projecting arm 60*a* of the device 60 for this purpose. This device 60 also includes a shorter arm 60*b* adapted to be engaged by a common trip lever 90.

The common trip lever 90 is pivotably provided on a cross shaft 100 extending through and between the adjacent circuit breaker half sections 200 and 300 so that rotation of this cross shaft 100 by one such lever 90 assures that another lever 90 in the adjacent circuit breaker mechanism will also trip the adjacent mechanism. Each trip lever 90 is spring biased downwardly by a torsion spring 102 as best shown in FIG. 1. The free end portion of the lever 90 engages a roller 98 provided for this purpose on the movable contact lever 18. Thus the opening movement of the control lever 18, and more particularly of the roller 98 provided on the contact lever for this purpose, assures that the common trip lever 90 moves from the solid line position to the phantom line position shown in FIG. 1. Since this lever 90 is secured to cross shaft 100 the one lever causes rotation of the cross shaft 100 and hence movement of the lever 90 in the adjacent circuit breaker mechanism as suggested in FIG. 3 by the broken lines indicated generally at 96. The cross shaft is indicated generally at 100 by a connecting line between the broken lines 96, 96 that represent the common trip levers 90, 90.

The above described action of the common trip levers or links 90, 90 is generally similar to that shown and described in the prior art U.S. Pat. No. 3,098,912 issued to J. M. Sprague in 1963. However, in Sprague as in many other prior art circuit breaker patents the configuration of the operating mechanism dictates an off-center configuration for the operating member actuator. One purpose of the present invention is to provide a multi-pole circuit breaker configuration wherein the operating member is centered in the overall housing of the circuit breaker case.

Crank arm 40 comprises one link in the three bar linkage action of the breaker mechanism itself. This crank arm 40 comprises a part of the operating lever or toggle in the prior art circuit breaker mechanism of issued U.S. Pat. No. 4,347,488 and other prior art circuit breaker constructions. This crank arm 40 is directly connected to the lower end of the pushbutton 10 by an integrally formed arm 10*a* and moves between the positions shown in FIG. 1 and FIG. 2 as the pushbutton 10 is moved. The pin 120 that connects arm 10*a* and crank arm 40 is loosely received in at least one of these two pivotably connected components. As so constructed and arranged downward movement of the pushbutton 10 from the FIG. 2 toward the FIG. 1 position will cause corresponding movement of the crank arm 40, and also cause the contacts 14 and 16 to close, provided only that the collapsible link 34/36 remains in the position shown for it in these views. The reader is referred to prior art U.S. Pat. No. 4,347,488 for a more complete description of the situation that occurs when an overcurrent condition persists and when one attempts to reset the circuit breaker in the manner described (that is by depressing pushbutton 10). Briefly, in such a case the collapsible link 34/36 will not function in the manner just described but will remain collapsed until the overcurrent condition ceases. The action of armature 33 and its arm 33*a* on the device 60 serves to prevent reclosing of the contacts during such an overcurrent condition.

As so constructed and arranged the pushbutton 10 and the crank arm 40 permit the circuit breaker mechanism just described to be provided in a circuit breaker housing wherein the pushbutton 10 is centrally located in the housing and not offset to one side of center as is the case with most prior art circuit breaker patents of this general type.

Figure 7:
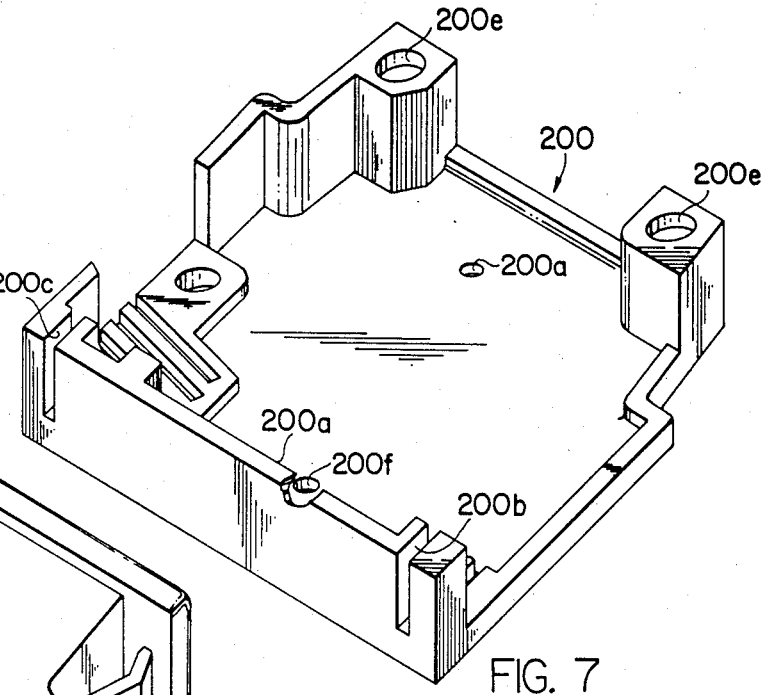
FIG. 7 is a perspective view illustrating one half section for one pole of the two pole circuit breakers illustrated in the drawings in FIGS. 1–6 inclusively.
Figure 8:
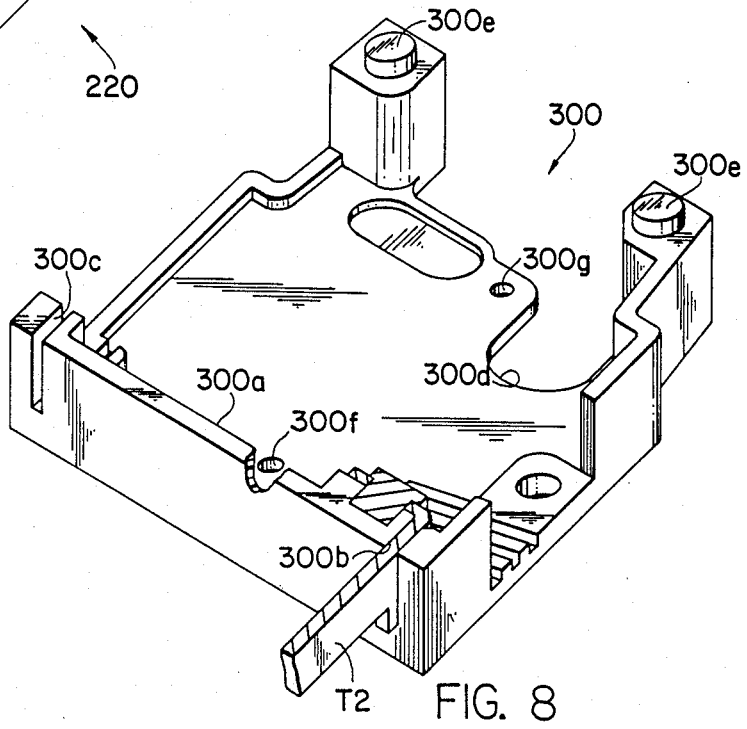
FIG. 8 is a perspective view of another half section adapted to mate with that of FIG. 7 to form a portion of the enclosure for one pole of the double pole circuit breakers illustrated in FIGS. 1–6.

Referring now to FIGS. 7 and 8 in greater detail, these views show half sections 200 and 300 respectively for use in opposed pairs to enclose each of the two circuit breaker mechanisms shown in the two pole breakers of FIGS. 1–3. These half sections are generally similar to one another but are adapted to mate with one another to provide side-by-side individual enclosures for each circuit breaker mechanism. The half section 200 shown in FIG. 7 has a bottom wall 200*a* which defines slots 200*b*, 200*c* for receiving the terminals T1 and T2. These slots align with similarly shaped slots 300*b*, 300*c* provided for this purpose in the mating half section 300 of FIG. 8. Bottom wall 300*a* of the half section 300 is aligned with bottom wall 200*a* of the half section 200 so as to define the bottom wall for the circuit breaker housing as best shown in FIG. 3. FIG. 8 shows one terminal T2 or at least a portion thereof in place in the slot 300*b*. Still with reference to FIG. 8 a cutout 300*d* is provided as shown to provide clearance for the cross shaft 120 that serves to link each of the crank arms 40, 40 to one another and to the pushbutton arm 10*a* so that movement of the single pushbutton 10 will achieve resetting of each circuit breaker mechanism in the two pole breaker shown.

Still with reference to FIG. 3 the half sections 200 and 300 have alignment holes 200*e* and integrally defined posts 300*e* respectively that fit together at assembly. These half sections include suitably placed openings 200*f*, 200*g* and 300*f*, 300*g* for receiving the end portions of pins F and G provided in the frame 42 of the breaker mechanism in order to properly locate the mechanism in its associated half section half section defined housing.

In further accordance with the present invention an outer shell 20 is provided around these side-by-side pairs of half sections. In the circuit breaker housing of FIG. 3 two such side-by-side circuit breaker mechanisms and associated half sections are surrounded by a shell 20 that serves to hold them in assembled relationship.

Figure 9:
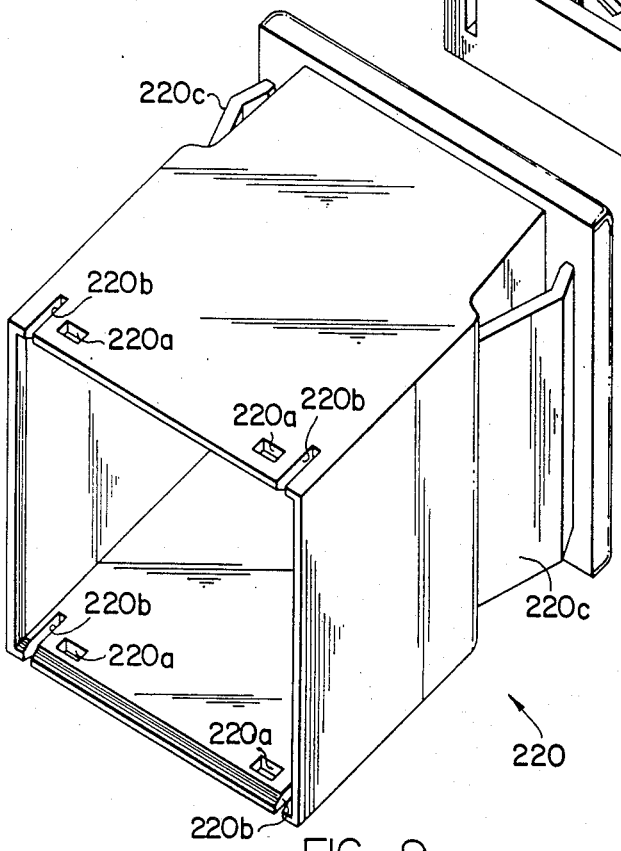
FIG. 9 is a perspective view of the outer shell provided around the mating half sections in the rocker switch version of FIG. 5.

The outer shell 220 of the FIG. 9 version illustrates typical means, defined in part by the outer shell and in part by the side walls of the half sections, that serve to hold these components in assembled relationship. Although FIG. 9 shows a slightly different configuration for the upper end of the outer shell 220 the lower end of the shell 220 is similar to the shell 20 of FIGS. 1–3. FIG. 9 shows an outer shell having openings 220*a* which are adapted to receive projections provided on the outside walls of the half sections 200 and 300 for this purpose. In order to improve the flexibility of the side walls of the outer shell 220 a plurality of relatively deep slots 220*b* may be provided outboard of these openings 220*a* in order to permit limited flexing of the side walls of the outer shell 220 at assembly. Although the shell 20 of FIGS. 1, 2 and 3 differs from the shell 220 of FIG. 9 the mating portions of the outer shell and half sections 200 and 300 are similar and function in the same way with the same openings and cooperative interfitting parts as described herein. FIG. 3 shows these slots 20*a* in the shell 20 and the associated projecting portions 202 and 302 defined for this purpose in the outside wall of the half sections 200, 300 respectively.

DETAILED DESCRIPTION OF FIGS. 4 AND 6

Figure 4:
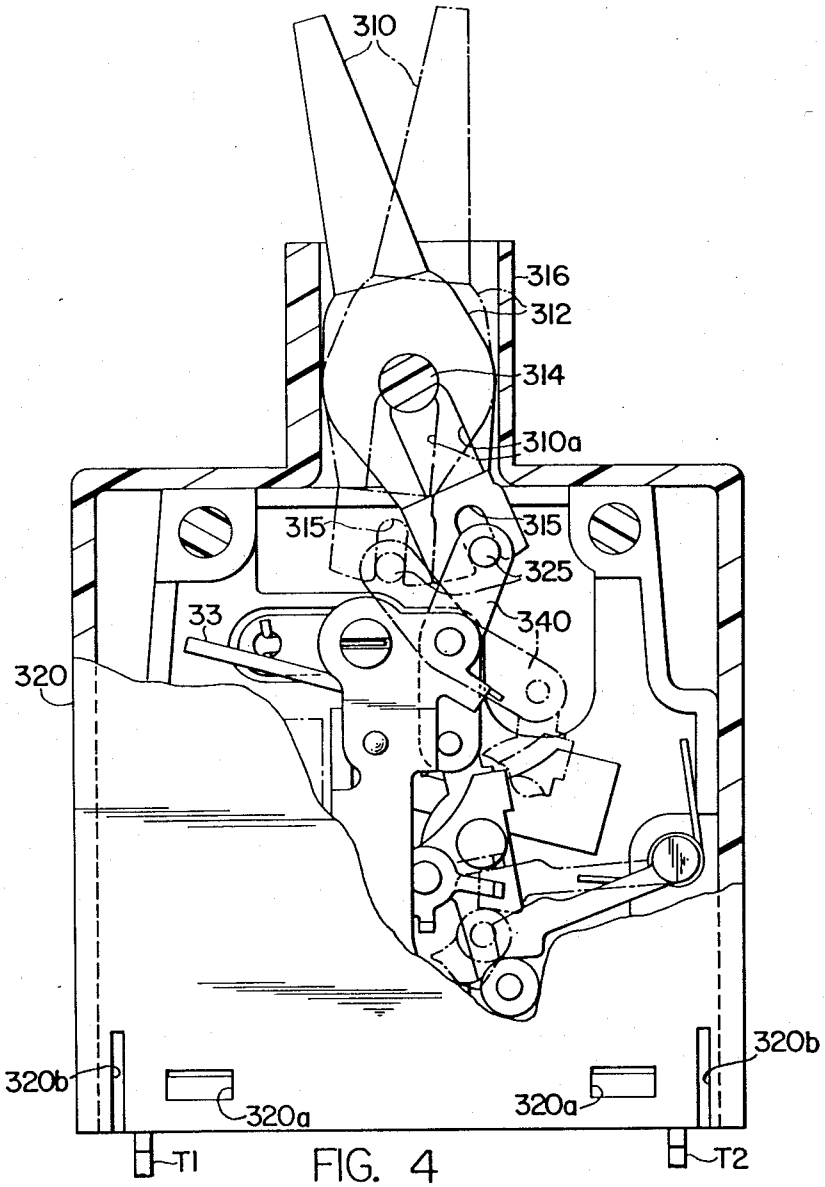
FIG. 4 is a side elevational view with portions broken away of an alternative circuit breaker configuration having a similar internal switching mechanism to that of FIGS. 1–3, but having a toggle actuator mechanism in place of the pushbutton actuator mechanism of FIGS. 1–3. The phantom line position in FIG. 4 illustrates the switch mechanism in an open condition, and the solid line position for the toggle corresponds to a contact closed condition for the breaker.

Turning next to a detailed description of the embodiment illustrated in FIG. 4, the internal circuit breaker mechanism of FIG. 4 is generally similar to that described with reference to FIGS. 1, 2 and 3 above, and the same terminals T1 and T2 are provided in the bottom wall of the circuit breaker as are the same interconnection means between the half shells surrounding the circuit breaker mechanisms and the outer shell 320. The outer shell 320 is broken away in FIG. 4 to reveal the internal breaker mechanism and the mechanism is identical to that of FIGS. 1–3 except for the configuration of the link 340 which is substituted for the link 40 of the breaker described previously. Link 340 is shown in two positions one in solid and one in phantom lines and in the solid line position shown, the armature 33 is raised and the contacts within the breaker (not shown) are closed. The solid line position in the breaker of FIG. 4 corresponds to the position of the breaker mechanism in FIG. 1. In the broken line position of FIG. 4 the contacts would normally be open and the link 340 in the broken line position is so constructed and arranged as to move the toggle 310 from the solid line position to the broken line position in FIG. 4.

Figure 6:
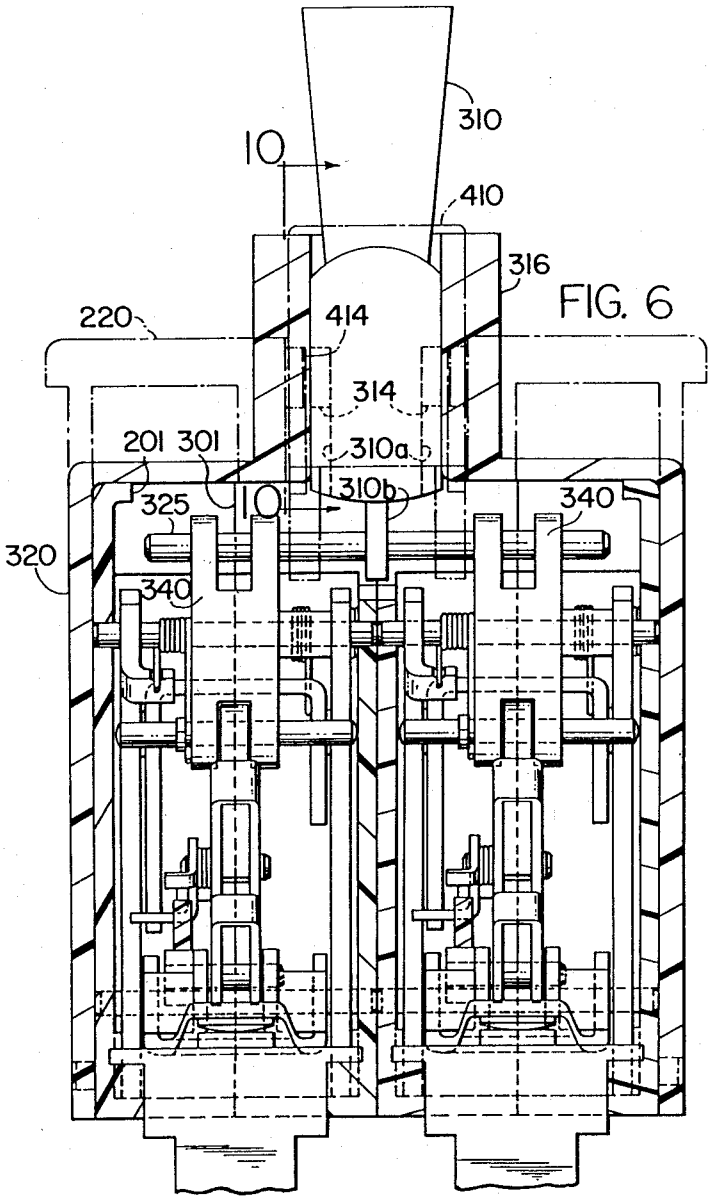
FIG. 6 is a sectional view corresponding to the sectional view of FIG. 2, but illustrating the internal circuit breaker mechanisms of FIGS. 4 and 5, the toggle switch version being shown in solid lines and the rocker switch version of FIG. 5 being illustrated in phantom lines.

FIG. 6 illustrates in solid lines the same breaker as illustrated in FIG. 4. That is, the links 340, 340 are interconnected by cross shaft or pin 325 which cross shaft is received in a downwardly open slot 315 provided for this purpose in the toggle 310. The toggle itself has an enlarged body portion 312 which includes axially aligned openings that receive axially aligned inwardly directed protuberances 314 provided for this purpose in the boss 316 of the outer shell 320. The toggle 310 has opposed downwardly open slots 310*a* which are so configured that the toggle 310 can snapped into place and be held by interference fit with the boss defined plugs 314. Toggle 310 also includes a dependent lower portion 310*b* which itself defines a downwardly open slot for receiving a mid-portion of the cross shaft 325 in order that the toggle 310 operate both circuit breaker mechanisms simultaneously.

It will be apparent that the outer shell must be configured differently for each of the pushbutton, toggle, and rocker type breakers of FIGS. 1–5. However, the "half" sections are similar in each breaker type.

DETAILED DESCRIPTION OF FIGS. 5–12

Figure 5:
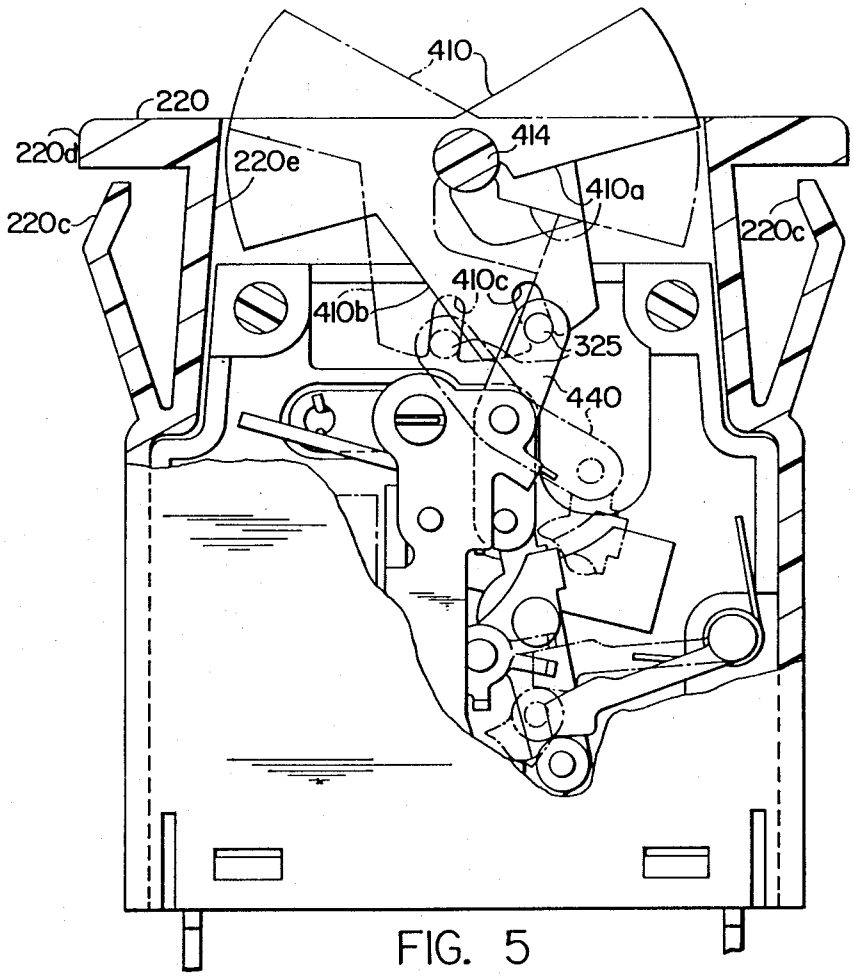
FIG. 5 shows a rocker switch actuated circuit breaker version with a slightly different housing configuration for mounting in a panel opening from the front of the panel rather than from the rear of the panel as is true of the previously described embodiments.
Figure 10:
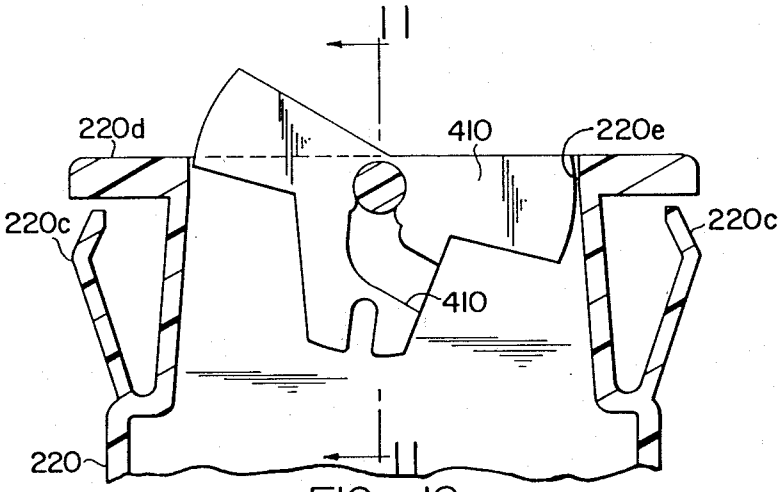
FIG. 10 is a vertical sectional view taken generally on the line 10—10 of FIG. 6 and illustrating only the rocker switch the circuit breaker mechanism and the half sections being omitted.
Figure 12:
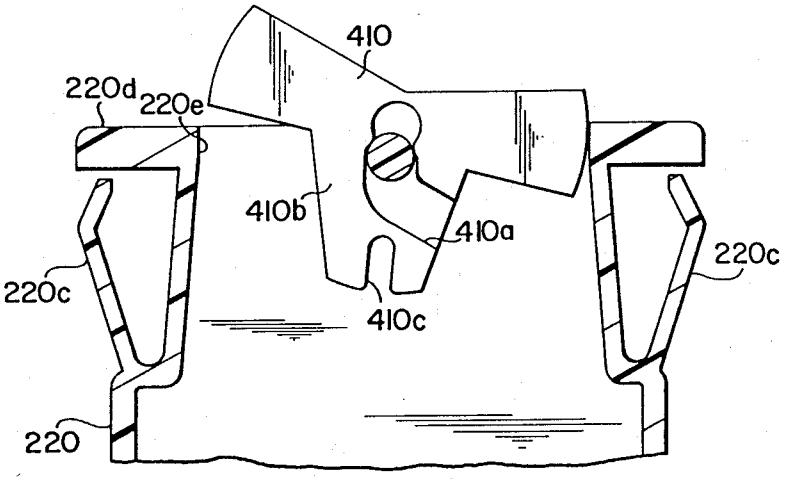
FIG. 12 is a view similar to FIG. 10, but illustrating the rocker in an initial stage of assembly with the outer shell of the circuit breaker case or housing.

FIG. 5 shows still another version of circuit breaker embodying the advantages of the present invention wherein the outer shell 220 is not adapted for rear mounting in a panel but rather is adapted for front mounting through a generally rectangular opening in the panel (not shown) and the breaker mechanism itself is adapted for operation by means of a rocker actuator 410. Two positions for the rocker 410 are indicated in FIG. 5 as are two positions for the crank arm 440 provided for operation of the breaker mechanism itself. The breaker mechanism is generally similar to that described previously and need not be described in detail. The outer shell 220 has been referred to previously with reference to FIG. 9, and includes suitable means defined in part by the lower walls of the outer shell 220 and by the internal half sections surrounding the individual circuit breaker mechanism. Here again, this interconnection between the outer shell and the interior half sections for the circuit breaker mechanisms has been described in detail above and need not be repeated here. The outer shell 220 includes upstanding wings 220*c* which are of conventional configuration and are adapted to cooperate with the underside of a flange 220*d* in order to mount the breaker from the front into a rectangular panel opening. The outer shell 220 of FIG. 5 includes a generally rectangular top opening 220*e* in which the rocker 410 is pivotably provided for rotation on an axis defined by the inwardly directed axle defining plugs 414, 414 defined for this purpose in the outer shell 220. The rocker 410 has outwardly open grooves 410*a* which are L-shaped as best shown in FIGS. 10 and 12 to permit assembly of the rocker in the opening 220*e* as suggested in FIG. 12, at least when the rocker and the crank arm 440 are in predetermined positions relative to one another. The opening 410*a* has a necked down portion so as to releasably retain the rocker in place once it has been assembled with the outer shell 220. The rocker 410 includes depending side walls 410*b*, 410*b* which define outwardly open slots 410*c*, 410*c* that are adapted to receive the cross shaft 325. FIG. 6 illustrates in phantom lines the configuration for the outer shell 220 and rocker 410 with the same half shells 200 and 300 and the same circuit breaker mechanisms as illustrated in prior embodiments. The crank arm 340 in FIG. 6 may be identical to the crank arm 440 illustrated in FIG. 5.

DETAILED DESCRIPTION OF FIGS. 13–20

Figure 13:
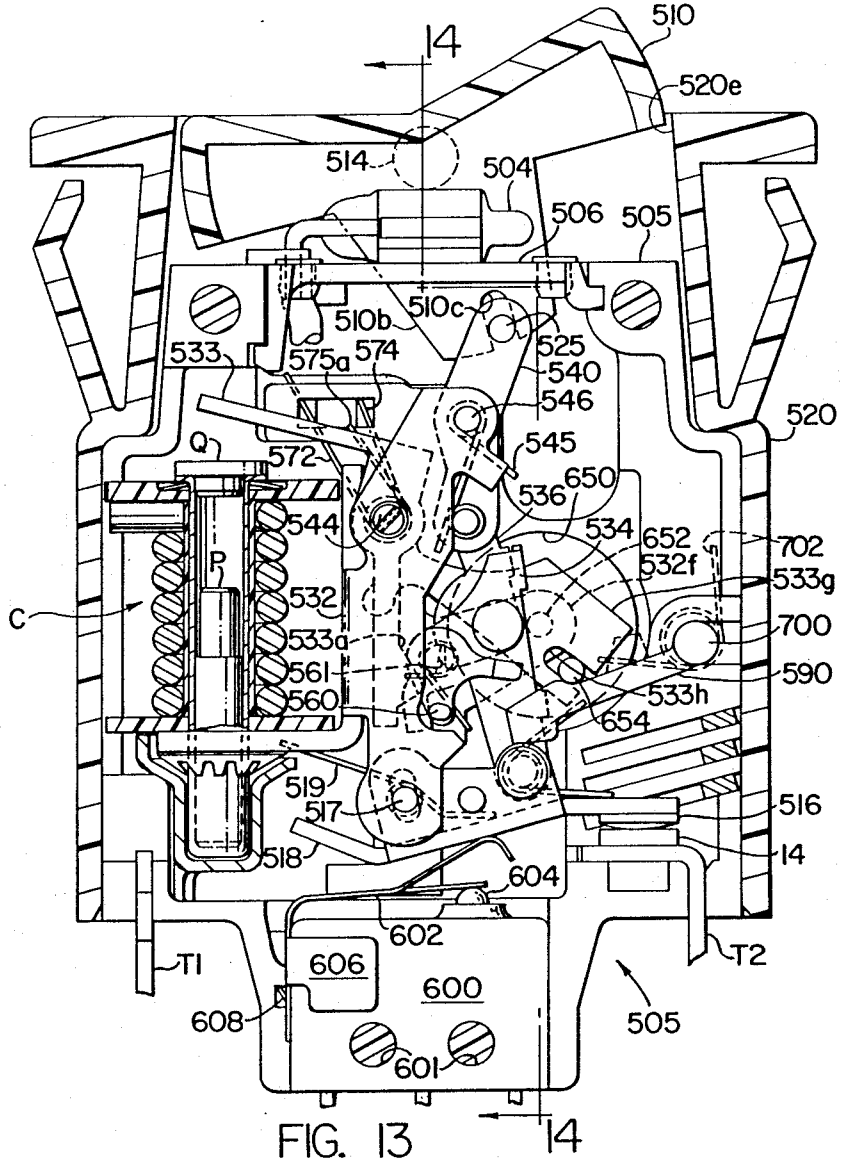
FIG. 13 is a vertical section through a preferred double pole rocker switch embodiment of the present invention with features as shown in the versions of FIGS. 1–12, but with additional features not shown in FIGS. 1–12.

FIG. 13 shows in elevation the presently preferred embodiment of the present invention in a rocker switch operated double pole circuit breaker wherein the mechanisms are similar to those described previously with reference to FIG. 1 with certain exceptions.

Figure 11:
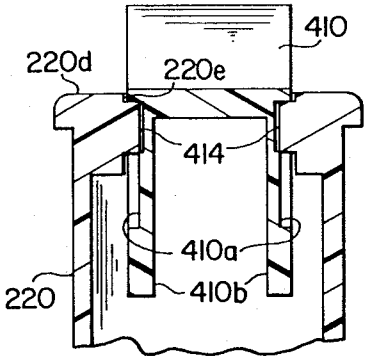
FIG. 11 is a sectional view taken generally on the line 11—11 of FIG. 10.

The outer shell or casing 520 is generally similar to the outer shell 220 described previously with reference to FIGS. 5–12. A perspective view of this outer shell 520 or 220 is depicted in FIG. 9. A transparent rocker actuator 510, generally similar to the actuator 410 of FIGS. 10, 11 and 12, is pivotably supported in an opening provided for it in the outer shell 520 and this rocker 510 can be conveniently assembled in the position shown as described hereinabove with reference to FIGS. 10, 11 and 12.

The outer shell 520 is assembled over "half" sections defining the two circuit breaker mechanism cavities for the double pole circuit breaker shown. Thus, the shell 520 has openings 520*a* best shown in FIG. 14 for receiving lugs 502 defined for this purpose on the left and right hand half sections 500 and 500' illustrated in FIGS. 19 and 20 respectively. These left and right hand half sections define portions of the left and right hand cavities for the identical circuit breaker mechanisms provided therein.

Figure 14:
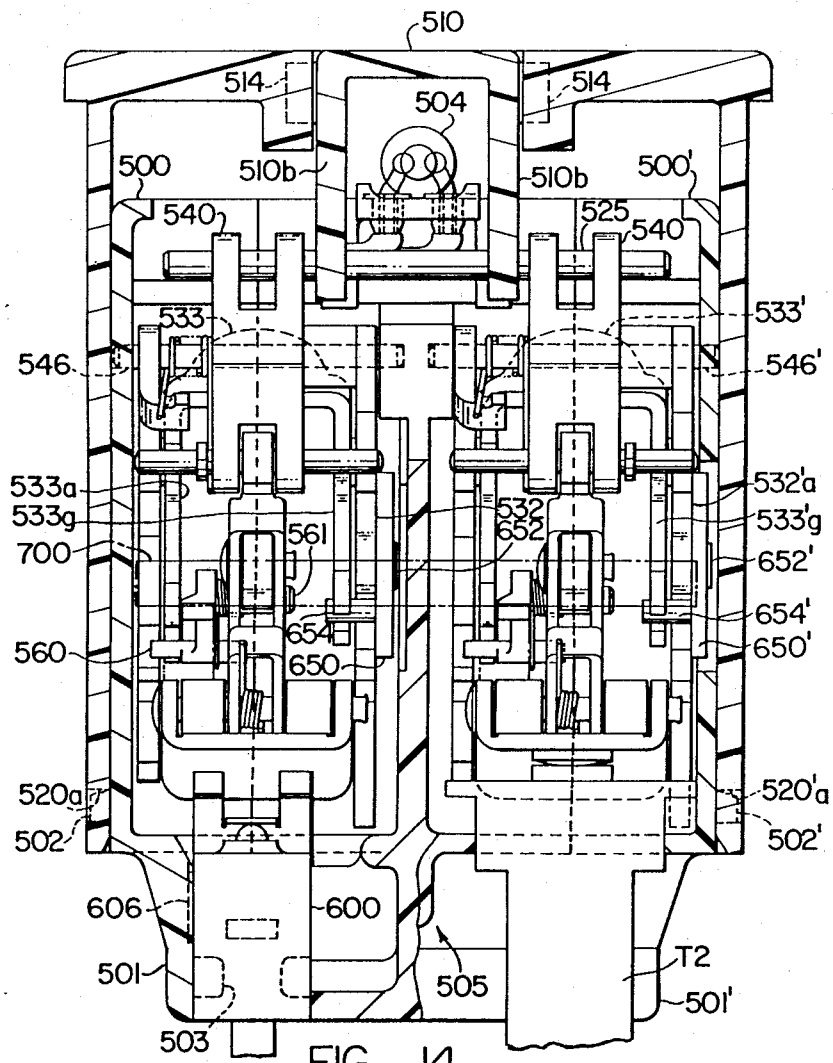
FIG. 14 is a sectional view taken generally along the line 14—14 of FIG. 13.
Figure 18:
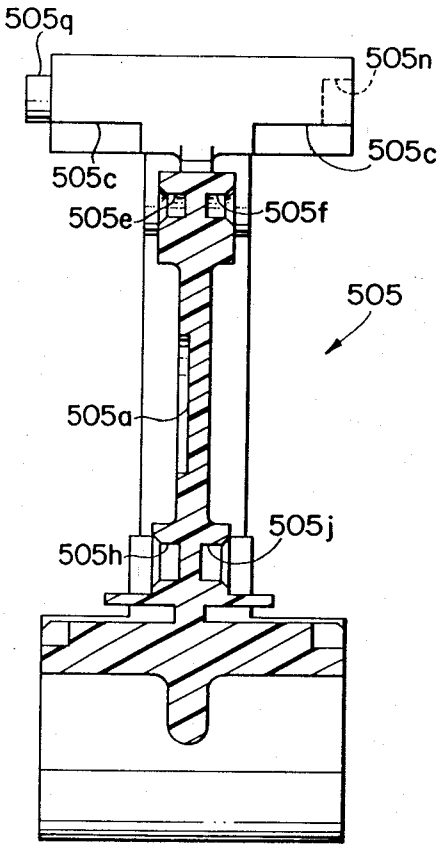
FIG. 18 is a sectional view taken on the line 18—18 of FIG. 15.
Figure 17:
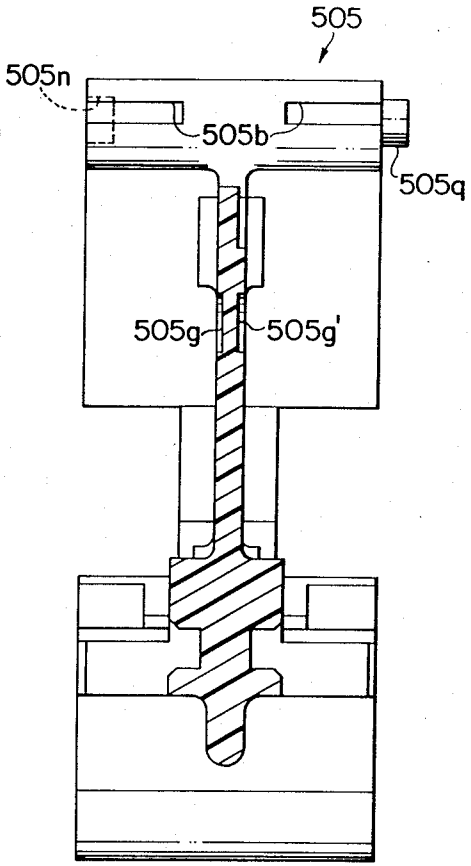
FIG. 17 is a sectional view taken on the line 17—17 of FIG. 15.

Two depending wells 501 and 501' are defined in part by the bottom wall of the left and right hand half sections 500 and 500' respectively. These walls bset shown in FIG. 14 are adapted to house miniature limit switches as illustrated generally at 600 in FIG. 13. One limit switch 600 may be provided and serves to produce an output signal in a remote indicator circuit for remotely indicating the condition of a particular circuit breaker. The limit switch 600 is of conventional configuration and is normally held in the position shown in FIG. 13 by lugs 503 or 503', which lugs are received in openings 601 in the limit switch itself. A spring lever 602 has a portion 606 to locate lever relative to the switch 600. The lever 602 acting between the underside of the movable contact arm 518 and the plunger 604 of the limit switch 600. When contact arm 518 is moved from the closed position shown to an open condition, such as suggested by the contact arm 18 in FIG. 2 of a previous embodiment, plunger 604 is biased upwardly by internal biasing means within the limit switch 600 opening or closing the remote indicator circuit associated with this limit switch to provide an indication at a remote location of circuit breaker condition.

Figure 15:
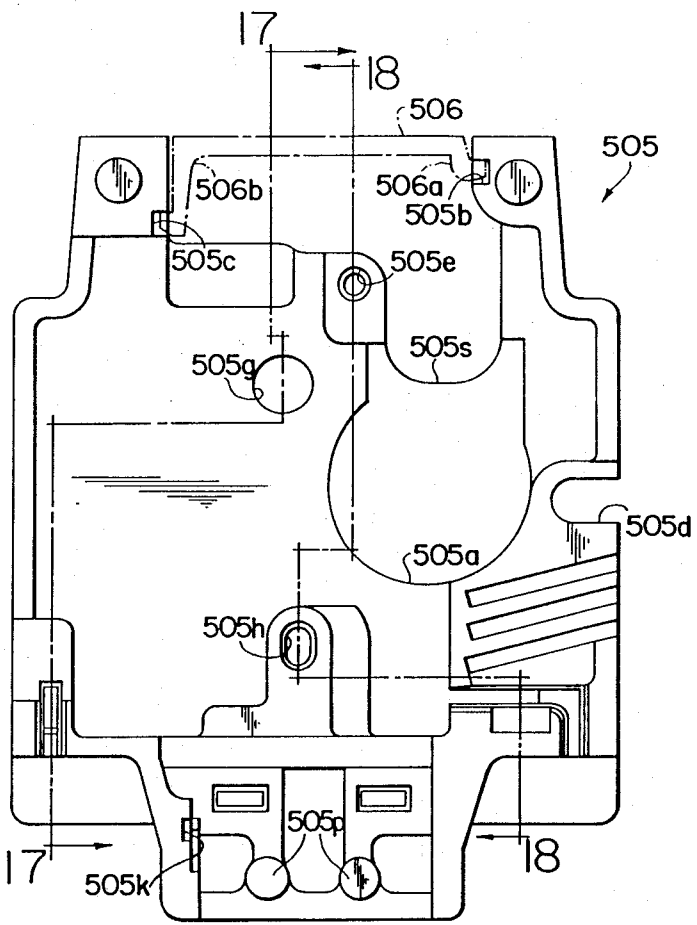
FIG. 15 is an elevational front view of the one piece "half" section that defines the common wall between the two circuit breaker mechanism cavities in FIG. 14.
Figure 16:
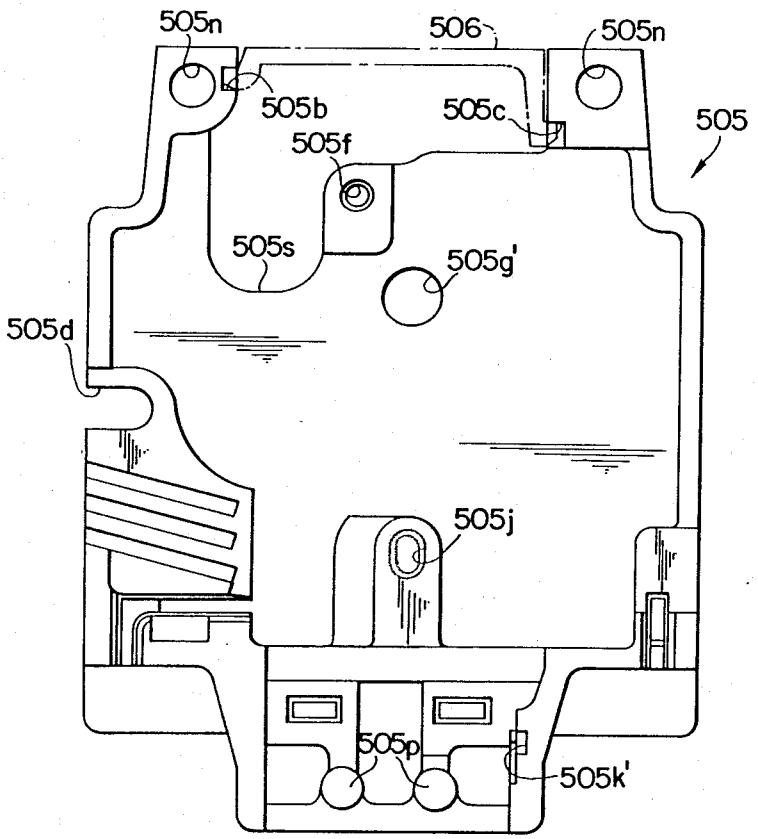
FIG. 16 is a rear view showing the back side of the same "half" section as shown in FIG. 15.

The circuit breaker of FIG. 13 also includes a small lamp 504 to indicate circuit breaker condition. Light from the lamp 504 is transmitted through a transparent portion of the rocker 510 for this purpose. As best shown in FIG. 14 lamp 504 is mounted between the side walls 510*b*, 510*b* of the rocker 510 on a fixed platform 506. This platform 506 is supported by a center "half" section 505, or divider wall best illustrated in FIGS. 15–18. The integrally molded center "half" section cooperates with the left and right hand "half sections" to define the two side-by-side cavities of this two pole circuit breaker. FIGS. 15 and 16 show the lamp support platform 506 in broken lines. Means for supporting the platform member 506 on the center wall "half" section 505 comprise openings 505*b* in the center half section 505 and lugs at the ends of the platform legs 506*a*, 506*b*. It will be apparent that the platform 506 can be used either to support a miniature lamp as suggested at 504 in FIGS. 13 and 14, or that the platform 506 might instead support a combination resistor and LED. The LED might also be provided on this platform 506 and the advantage to providing for selective installation of the platform 506 in this manner permits the same center wall configuration 505 to be used for a rocker actuated circuit breaker without a lamp or for use in other breaker housings. Thus, center "half" section 505 is also usable in other multi-pole circuit breakers similar to those illustrated generally in the earlier described embodiments, as for example a pushbutton or toggle operated type of circuit breaker.

The individual cavities for each pole of the two pole circuit breaker are defined by left and right "half" sections assembled with the above mentioned center "half" section 505. FIG. 14 shows these various components in assembled relationship and FIG. 15–20 show these "half" sections in greater detail as individual molded plastic components of the double pole circuit breaker illustrated in FIGS. 13 and 14.

Turning now to a brief description of the two circuit breaker mechanisms the rocker 510 is pivotably supported in the top opening 570*e* of the outer shell 520 by integrally defined axle portions 514, 514 that are received in openings provided for them in the shell. This opening 520*e* is generally similar to the opening 220*e* referred to previously with reference to the rocker switch operated circuit breaker of FIGS. 10, 11 and 12. The rocker 510 has parallel depending legs 510*b*, 510*b* between which legs the lamp 504 is provided on the platform 506 as described previously. Each depending leg 510*b* defines a downwardly open slot 510*c* for engagement with a cross shaft or pin 525 extending through opening 505*s* across and between both circuit breaker mechanisms in order that both circuit breaker mechanisms can be reset by the single rocker 510.

As best shown in FIG. 14 the cross shaft 525 is supported in upstanding crank arms 540, 540 that are in turn supported on pins 546, 546 in each of the two circuit breaker mechanism frames 532, 532. Each frame is of generally conventional geometry providing support for various pins and levers making up each circuit breaker mechanism. A coil C carries current through terminals T1 and T2 in the bottom wall of each circuit breaker mechanism cavity by suitable internal conductors (not shown) in order to provide during an overcurrent condition sufficient magnetic force, through plunger P and pole piece Q, to pull armature 533 downwardly. Each breaker mechanism may be wired for conventional series trip, shunt trip, relay trip, or with an auxiliary switch as suggested in FIGS. 13 and 14.

The armature 533 is pivotably supported on a pin 544 provided for this purpose in the frame 532 and a friction spring is wound around the pin 544 and has leg portions 572 and 574 engaging opposite side edges of an opening in the frame 532. The armature 533 also has a return spring 575 with a leg 575*a* engaging the underside of the armature 533 to return the armature to the normal position shown. The force exerted by return spring 575 on the armature can be adjusted by rotating the pin 544. Spring 575 having an opposite leg received in a slot defined by the pin 544.

Movable contact lever 518 is normally biased toward the open condition (not shown) by a torsion spring 519. This lever 578 is held in the closed position shown by a three bar linkage consisting of the movable contact lever itself 518, a collapsible link in the form of elements 534 and 536, and the above mentioned crank arm 540. The movable contact lever 518 and the crank arm 540 are pivotably supported in the fixed frame 532, as is the armature 533 mentioned previously. However, pin 517 that supports the lever 518 is provided in an elongated opening to provide for the movement of the collapsible link 534/536. This collapsible link 534/536 is collapsible by action of a depending armature portion 533*a* acting on a device 560 provided for this purpose on the link 534. The device 560 has a projection that is engaged by the depending portion 533*a* of the armature 533 when the coil C and plunger P pull the armature against pole piece Q. Another arm of the device 560 is adapted to be engaged by a common trip link 590 pivotally mounted in the each of the circuit breaker cavities. Each common trip link 590 is coupled to an associated circuit breaker mechanism by a cross shaft 700 that extends through a slot 505*d* in center "half" section 505 across and between the entire two pole breaker assembly for this purpose. Each common trip link 590 has a return spring 702, best shown in FIG. 13, and the function and operation of the common trip link is described in greater detail hereinabove with reference to FIGS. 1 and 2.

In keeping with a primary purpose of the present invention, namely to provide the actuating means for the breaker in centered relationship, not only between the two poles of the breaker but also in centered relationship between the opposite sides of the housing, that is, the coil side and the movable contact arm side of the circuit breaker housing.

A common trip link 590 is provided on one side of each circuit breaker cavity and on the opposite side of each cavity an inertia wheel 650 is provided. Each inertia wheel is pivotably supported on a pin 652 provided in a projecting leg 532*f* of the fixed frame 532. Each inertia wheel 650 is received in a circular opening 500'*a* in the right hand half section 500' and in one side of the center half section 505. These generally circular recesses 500'*a* and 505*a* provide clearance for the intertia wheel 650 so that each wheel is provided at least in part to one side of the normal cavity associated with each circuit breaker mechanism.

Inertia wheels have been provided in prior art circuit breaker mechanisms to impede armature closing action and contact arm opening For example prior art inertia wheels have been provided on the trailing arm of the armature 533*g* so as to be spun up by a fixed pin provided in a slot defined by the inertia wheel itself. This geometry adds unnecessary and undesirable inertia and weight to the moving armature mechanism itself and the present invention provides the inertia wheel directly on fixed frame itself. In accordance with the present invention a slot 533*h* is provided in the trailing arm 533*g* of the armature to engage a pin 654 defined for this purpose in the inertia wheel. Pin 654 and slot 533*h* provide pin and slot means for coupling said wheel to the fixed frame. The axis of rotation for the inertia wheel is defined by stub shaft 652, which axis is located between this pin and slot coupling means and the armature pivot axis. As a result of this geometry armature rotation toward the pole piece Q will move the trailing arm 533*g* of the armature causing pin 654 to rotate the inertia wheel 650 thereby impeding the speed of movement of the armature and delaying slightly the action of the arm 533*a* of the armature in collapsing the link 534/536 by the action of the coupling device 560. It will be apparent that the above described relative locations for the inertia wheel axis and the pin and slot coupling means will create a greater degree of angular wheel rotation than prior art inertia wheel configurations. For example, the prior art U.S. Pat. to Merriken et al, No. 3,497,838, shows a frame mounted inertia wheel with pin and slot coupling means to achieve wheel rotation in response to armature closing. However, the small angular travel of the wheel dictates use of a more massive wheel than that possible with a wheel located as disclosed herein. With the geometry described above larger angular displacement of the wheel permits lighter wheels to provide equivalent damping action for the armature and consequently for the contact arm of the breaker.

FIG. 13 illustrates the outer shell 520 of the circuit breaker housing in vertical section and also illustrates the center "half" section 505 contained therein. As can be seen from FIG. 13 and FIGS. 15 and 16 this center "half" section 505 is open at the top so as to receive the platform 506. The depending legs 506*a* and 506*b* of platform 506 having portions received in openings 505*b* and 505*c* defined for this purpose in the center "half" section 505. As mentioned previously the generally circular recess 505*a* provides clearance for the rotation of inertia wheel 650 and its associated axle 652.

Still with reference to FIG. 15, the side opening slot 505*d* provides a through opening for the cross shaft 700 associated with the common trip links. This shaft 700 is not supported in the left and right hand "half" sections as shown in FIG. 14. Recesses 500*d* and 500'*d* in the left and right hand "half" section and 505*h*, 505'*h* are slightly elongated and sure to locate the ends of pins 517, 517 associated with the movable contact arms 516, 516. Crank arm support pivot pins 546, 546 are provided in openings 500*e* and 500'*e* in the left and right hand "half" sections and in openings 505*e* and 505*f* provided for them in the opposing sides of the center "half" section 505.

The armature support pin 544 also has end portions received in openings 500*b* and 500'*b* in the left and right hand half sections, and similar openings 505*g* and 505'*g* are provided in opposite sides of the center "half" section for the same purpose. These pin support openings secure the frame and associated breaker mechanism components in assembled relationship within the cavity defined by the "half" sections. The frames 532, 532 define elongated openings that match those described above for contact arm support pins 517, 517, so that these pins 517 are free to float in these slotted openings under the forces exerted upon them by the circuit breaker mechanisms including the return spring 519 associated with the movable contact arm 518 for urging this arm toward its open condition and the collapsible link 534/536. The collapsible link elements 534 and 536 also have associated return springs and the above described elongated openings provided for the pins 517, 517 allow for the movement of these link elements past a center position to and from that shown in FIG. 13.

Figure 20:
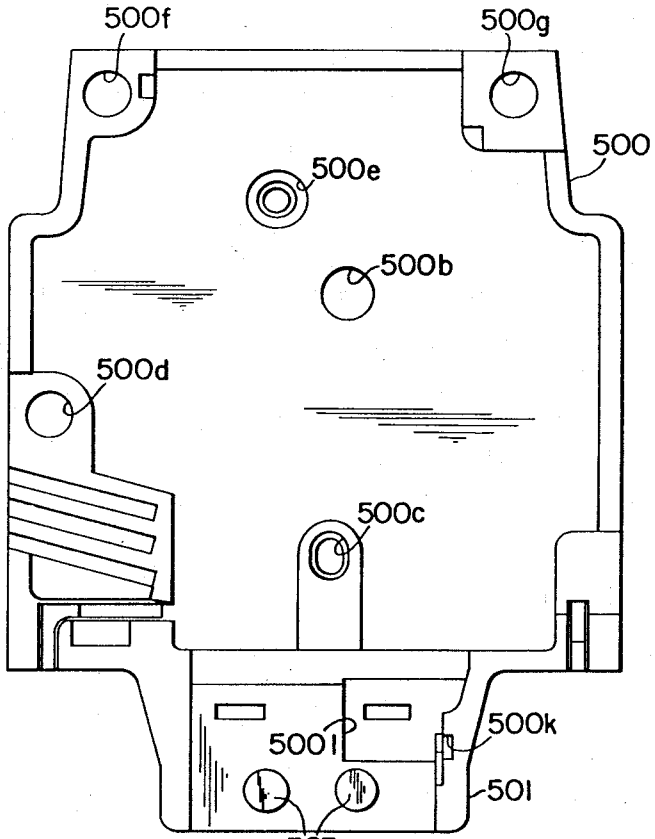
FIG. 20 is an elevational view of the left hand half section illustrated in FIG. 14.

Still with reference to the "half" section 505, 500 and 500' illustrated in FIGS. 15–18 inclusively, and referring more particularly to the lower portions thereof, downwardly open wells are defined for receiving at least one conventionally configured miniature limit switch such as that illustrated generally at 600 in FIG. 13. As described previously, a limit switch 600 is provided in one such well. The well is defined in part by the center half section 505 and in part by the left or right half section 500 and 500'. The limit switch 600 has mounting holes 601 that receive integrally formed posts 503 and 503. The center "half" section 505 defines posts **505*p* that are also received in the switch mounting holes 601. The limit switch 600 is activated by an associated movable contact arm 518 through spring lever 602. The lever 602 is secured in place relative to the housing half sections by a tang or ear 608 on the spring 602 that fits into a recess 505*k*, provided for it in the center half section 505 as best shown in FIG. 13. This spring lever 602 also includes an arm 606 that is received in recesses 5001 defined by the left "half" section as best shown in FIG. 20. As described previously this spring lever 602 activates the limit switch 600 in response to contact arm 518 motion and is securely anchored in place relative to the "half" sections 500 and 505**.

Figure 19:
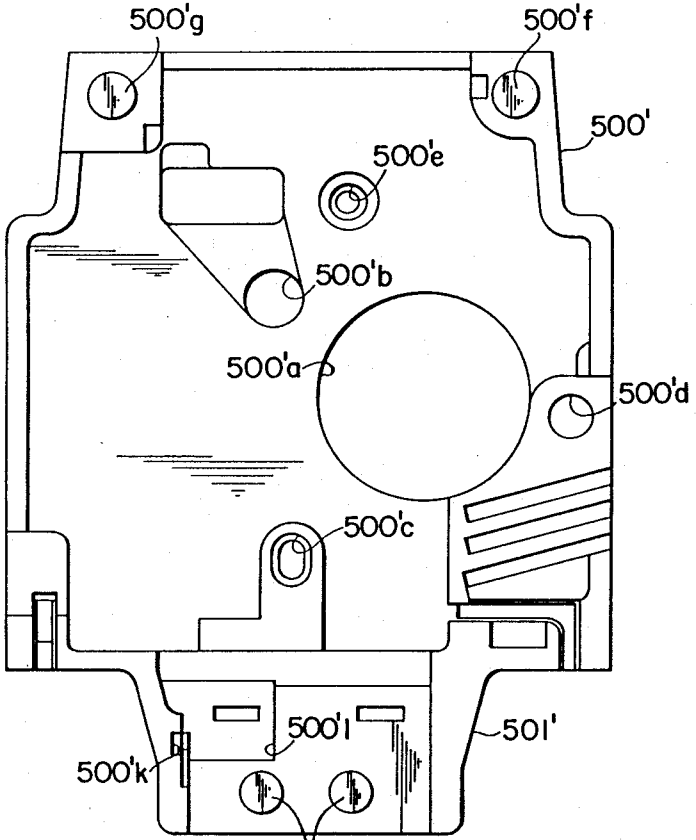
FIG. 19 is an elevational view of the right hand half section illustrated in FIG. 14.

The left and right hand half sections 500 and 500' of FIGS. 19 and 20 are similar to the opposed sides of half section 505 and define cavities for the circuit breaker mechanism components corresponding closely to the cavities defined on either side of the center half section 505. For example, the downwardly open well 501 for switch 600 includes cavities **500*k* provided to secure the spring 602 associated with the limit switch tang 608. The right hand half section has laterally outwardly extending posts 500'*g* and 500'*f* that fit into openings 500*f* and 500*g* /of the left hand half section when a single pole breaker is to be made up. Obviously in any single pole breaker the outer shell would be smaller in the lateral direction, and the centered actuator could be directly connected to the actuator link 540. In the double pole version the center half section must be provided between these left and right hand "left" sections and these integrally defined posts 500'*f* and 500'*g* fit into openings 505*n* as suggested in FIG. 18. Integrally defined posts 505*q* on the opposite side of this center "half" section 505 fit into the openings 500*f* and 500*g* of the left hand "half" section 500 of FIG. 20**.

Alternatively a three pole circuit breaker can be constructed simply by providing two center "half" sections between a left and right hand half section. The openings **505*n* of one center half section receive the pins 505*t*** in the second center "half" section in such a three pole circuit breaker assembly (not shown). The outer shell for such a breaker assembly would be correspondingly longer.

With three "half" sections left, center and right stacked as shown in FIG. 14 it will be apparent that the outer shell 520 can be provided around these stacked "half" sections to bring the above mentioned openings **520*a* in the shell into engagement with the lugs 502 and 502'** in the left and right hand "half" sections to provide a secure assembly that does not require the use of rivets or other fasteners. An improved circuit breaker of minimal rectangular volume is provided, having a single centered actuator for a two pole circuit breaker. The two breaker mechanisms are provided in stacked relationship in a compact unit that can be conveniently mounted in a panel either from the front of the panel, with the rocker switch version, or from the rear of the panel with a pushbutton or toggle switch version. In any case the actuator whether it be rocker, toggle or pushbutton is conveniently located in centered relationship on the top or front of the breaker itself.

The version of FIGS. 13–20 inclusively is similar to the above described embodiments of FIGS. 1–12 inclusively in that terminals T1 and T2 are provided in slots defined in part by the mating half sections. FIG. 14 shows one such terminal at T2, which terminal has an offset upper portion to carry a fixed contact 14. The movable contact 516 on contact lever 518 is shown in engagement with fixed contact 14. It is held in this position by the three bar linkage, of which the contact arm 518 is but one link. As mentioned previously the device 560 includes an arm that is engaged by depending portion **533*a* of armature 533. This device 560 has a camming portion 561 that serves to engage the back side of link 536 to collapse the link 534/536 in response to an overcurrent condition in the coil C. This geometry also provides for the link 534/536 to remain collapsed when an overcurrent condition persists and in spite of attempts to manually reset the breaker by means of the rocker switch 510. A spring 545 is wound around cross shaft 546 associated with the crank arm 540 to urge the crank arm from the position shown to a rocker open position (not shown) associated with opening of the contacts 14 and 516. This spring 546 serves to move the rocker 510 to the open position once the breaker has been tripped. Thus, the rocker does provide a visual indication to the observer of the breaker condition, particularly if the rocker itself has some indicia imprinted thereon. In the preferred embodiment shown a lamp 504 is provided to be energized by the above mentioned indicator circuit and to provide visual indication of breaker condition. The limit switch 600 provides remote indication of breaker condition. Circuitry (not shown) can be provided to the terminals 605 of switch 600** for this purpose.

In summary, a unique circuit breaker housing is provided such that the rocker or actuator is located centrally of the housing top or face, and such that the overall size of the double pole version shown is significantly smaller than that of prior art breaker housings. An outer shell defines the top opening for pivotably supporting the actuator, and in the preferred rocker version a lamp is provided behind the rocker to indicate the breaker's condition (on/off). Half sections are provided to support at least two breaker mechanisms in the preferred two pole version. The center "half" section defines in part two adjacent circuit breaker cavities, including two adjacent auxiliary switch cavities. Left and right hand "half" sections can be assembled with a center "half" section to provide either a rocker, toggle, or pushbutton operated compact circuit breaker.

I claim:

1. A circuit breaker including a circuit breaker mechanism and a molded plastic housing, said housing comprising at least two half sections adapted for assembly in mating relationship to one another to define at least one chamber for at least one circuit breaker mechanism, said assembled half sections cooperating with one another to define a generally rectangular parallelpiped with a bottom wall having aligned slots to receive terminals for the breaker switching mechanism, said slots defined in part by each of said two mating half sections, said half sections having portions abutting one another to define end walls and having spaced parallel side walls with openings to receive the ends of at least one cross shaft in said circuit breaker switch mechanism in order to locate the mechanism in said chamber, said half sections cooperating to define an open top, said housing also including an outer shell surrounding the assembled half sections and having side walls overlying said half section side walls and end walls overlying said abutting half section end walls so that said outer shell prevents separation of said assembled half sections, said outer shell having a top overlying said open top of said assembled half sections, an actuator for manually operating said breaker mechanism, said outer shell having a top opening to receive said actuator, and means for securing said half sections in assembled relationship with said outer shell, said means defined in part by said half sections side walls and in part by said outer shell side walls.

2. The combination defined in claim 1 further characterized by at least one center half section cooperating with said at least two half sections to define a second chamber for a second circuit breaker mechanism, said center half section and said two half sections being assembled in stacked relationship with said two half sections at left and right hand ends and said center half section therebetween, said outer shell surrounding all of said stacked half sections, said shell having said end walls overlying said stacked half section end walls.

3. The combination of claim 1 wherein said means for securing said half sections in assembled relationship with said outer shell comprise openings in said shell side walls and projecting portions defined in said half sections adapted to fit into said shell openings at assembly.

4. The combination of claim 1 wherein said half sections have locating means defined in part by each half section for aligning said half sections with one another to facilitate assembly with said outer shell.

5. The combination of claim 2 wherein said top wall of said shell has an upstanding boss defining said top opening, said actuator comprising a pushbutton slidably received in said boss, each said circuit breaker mechanism including an actuator link, a cross pin connecting said actuator links, and means coupling said pushbutton to said cross pin for operating both breaker mechanisms as a result of slidable movement of the centrally located pushbutton.

6. The combination of claim 2 wherein said top wall of said shell has an upstanding boss defining said top opening, said actuator comprising a toggle pivotably provided in said boss, each said circuit breaker mechanism including an actuator link, a cross pin connecting said actuator links, and a downwardly open recess in said toggle actuator for receiving said cross pin and operating both breaker mechanisms as a result of pivotable movement of the centrally located toggle.

7. The combination of claim 2 wherein said top opening of said shell has a rectangular shape, said actuator comprising a rocker pivotably provided in said rectangular opening, each circuit breaker mechanism including an actuator link, a cross pin connecting said actuator links, said rocker having depending side walls defining slots for receiving said cross pin to operate both breaker mechanisms as a result of pivotable movement of said centrally located rocker.

8. The combination of claim 2 wherein said at least one center half section comprises a one piece molded member having opposed faces that cooperate with said half sections at the left and right hand ends of said stacked half sections to define at least two identical circuit breaker chambers, said left and right half sections having chamber defining faces corresponding to said opposed faces of said center half sections.

9. The combination of claim 8 wherein said center half section has a relieved top portion, a lamp support platform mounted to said center half section, and circuit means including a selectively energizable lamp provided on said platform, said actuator having a transparent portion to pass illumination from the lamp to provide a visual indication of circuit breaker condition.

10. The combination of claim 7 wherein said center half section has a relieved top portion, a lamp support platform mounted in said center half section relieved portion, and circuit means including a lamp selectively energized in response to circuit breaker condition, said rocker having a transparent portion to pass illumination from said lamp to provide visual indication of circuit breaker condition.

11. The combination of claim 8 wherein said outer shell further includes a peripherally extending flange surrounding said rectangular top opening, and at least two resilient wings defined by said outer shell to facilitate mounting of said breaker in a panel opening or the like.

12. The combination of claim 7 wherein said rocker side walls define generally L-shaped indentations, said rectangular top opening of said shell has axle defining projections, said axle defining portions being received in said L-shaped indentations for assembly of said pivotably mounted rocker with said shell, said cross pin receiving said slots in said rocker sidewalls at assembly.

13. The combination of claim 8 wherein said at least one center half section cooperates with said half sections at said left and right hand ends of said stacked half sections to define at least two downwardly open switch cavities, and a limit switch in at least one of said two switch cavities.

14. The combination of claim 1 wherein said circuit breaker mechanism includes a frame, said cross pin being journaled in said frame, an armature pivotably supported in said frame for limited movement on an armature axis, an inertia wheel pivotably supported in said frame for movement on an inertia wheel axis parallel to and spaced from said armature axis, pin and slots means defined in part by said armature and in part by said inertia wheel to cause rotation of said wheel in response to pivotal movement of said armature, said inertia wheel axis being located between said armature axis and said armature in part defined by pin and slot means to maximize the angular rotation of said wheel in response to said limited pivotal armature movement.

15. The combination of claim 14 further characterized by at least one center half section cooperating with said at least two half sections to define a second chamber for a second circuit breaker mechanism, said center half section and said two half sections being assembled in stacked relationship with said two half sections at left and right hand ends and said center half section therebetween, said outer shell surrounding all of said stacked half sections, said shell having said end walls overlying said stacked half section end walls.

16. The combination of claim 15 wherein said at least one center half section comprises a one piece molded member having opposed faces that cooperate with said half sections at the left and right hand ends of said stacked half sections to define at least two identical circuit breaker chambers, said left and right half sections having chamber defining faces corresponding to said opposed faces of said center half sections.

17. The combination of claim 16 wherein one of said opposed faces of said center half section defines a recess for one inertia wheel associated with one breaker mechanism, one of said end half sections also defining a recess for a scond inertia wheel associated with said second breaker mechanism, each breaker mechanism having a frame leg for pivotably supporting said wheel, said frame leg provided between said wheel and said armature pin and slot defining means.

18. The combination of claim 17 wherein said pin and slot means comprise a pin provided adjacent the periphery of said inertia wheel, and a slot provided in said armature, said pin having an arcuate path of travel dictated by said inertia wheel's rotation, said arcuate path lying outside of and beyond said frame leg.

* * * * *